United States Patent [19]

Gast et al.

[11] Patent Number: 5,024,708

[45] Date of Patent: Jun. 18, 1991

[54] CASTABLE AND/OR PRESSABLE GAS GENERATING PROPELLANTS

[75] Inventors: Eduard Gast, Kraiburg; Peter Semmler, Aschau, both of Fed. Rep. of Germany

[73] Assignee: Contec Chemieanlagen GmbH, Aschau a, Fed. Rep. of Germany

[21] Appl. No.: 551,189

[22] Filed: Jul. 11, 1990

Related U.S. Application Data

[63] Continuation-in-part of Ser. No. 301,542, Jan. 24, 1989, abandoned.

[30] Foreign Application Priority Data

Feb. 10, 1988 [DE] Fed. Rep. of Germany ..... 3804095

[51] Int. Cl.[5] ..... C06B 45/10

[52] U.S. Cl. ..... 149/19.1; 149/19.4; 149/19.5; 149/19.7; 149/19.9; 149/92

[58] Field of Search ..... 149/19.1, 19.4, 19.5, 149/19.7, 19.9, 92

[56] References Cited

U.S. PATENT DOCUMENTS

| | | | |
|---|---|---|---|
| 2,929,699 | 3/1960 | Audrieth et al. | 149/92 |
| 3,138,497 | 6/1964 | Kennedy | 129/19.7 |
| 3,161,550 | 12/1964 | Mosher et al. | 149/19.7 |
| 3,383,860 | 5/1968 | Sayles | 149/19.9 |
| 3,732,131 | 5/1973 | Haury et al. | 149/19.8 |
| 3,909,323 | 9/1975 | Flanagan et al. | 149/19.7 |
| 3,954,528 | 5/1976 | Chang et al. | 149/19.4 |
| 4,092,188 | 5/1978 | Lovelace | 149/19.4 |
| 4,172,743 | 10/1979 | Goddard | 149/22 |
| 4,234,363 | 11/1980 | Flangan | 149/19.4 |
| 4,288,262 | 9/1981 | Flanagan et al. | 149/19.1 |

*Primary Examiner*—Edward A. Miller

*Attorney, Agent, or Firm*—Bierman and Muserlian

[57] ABSTRACT

Gas generating propellants with flame temperatures below 1400° K. (isobaric) based on duroplastic and/or thermoplastic binders containing up to 80% by weight of triaminoguanidine nitrate as the chief gas generating component which can be cast or pressed into shapes having good chemical stability and excellent mechanical properties useful in propulsion engines and energy yielding systems.

2 Claims, No Drawings

CASTABLE AND/OR PRESSABLE GAS GENERATING PROPELLANTS

This application is a continuation-in-part of copending U.S. applications Ser. No. 301,542 filed Jan. 24, 1989, now abandoned.

STATE OF THE ART

DE-AS 2,329,558 describes gas generating compositions comprised of monomeric and polymeric esters of nitric acid, a polymeric binder and combustible nitrogenous compounds with decomposition temperatures of less than 2000° K. Due to the large amounts of up to 40% by weight of each of the monomeric and polymeric esters of nitric acid, the compositions lack stability and therefore have a short shelf life and a reduced use life. Moreover, the monomeric nitric acid esters have a tendency to migrate causing problems by exudation, separation of the inhibition and/or undesirable migration into the insulation.

DE-AS 2,263,860 describes solid propellant charges containing triaminoguadinine nitrate and cellulose nitrate plastized with liquid nitric acid esters. Apart from the problems of solid and liquid nitric acid esters, the flame temperature of the propellants is about 2500° K. DE-PS 2,449,778 describes a propellant powder comprising a linear and a cyclic nitramine, ethyl cellulose and/or isodecylpelargonate as the binding agent. Triaminoguanidine nitrate is indicated as a nitramine although it is not a nitroamine and octogen is deemed a cyclic nitramine but the flame temperatures of the composition are 1900 to 2,200° K. (isobaric). Moreover, propellant charges are used for purposes other than gas generation and therefore require other burning properties.

OBJECTS OF THE INVENTION

It is an object of the invention to provide a gas generating composition which doesn't show the beforementioned shortcomings of nitric acid esters but has a low flame temperature, a burning rate adjustable within a specified range, capable mechanical properties and a chief constituent which is neither hygroscopic nor mechanically sensitive or difficult to handle like ammonium nitrate as a result of phase transitions.

This and other objects and advantages of the invention will become obvious from the following detailed description.

THE INVENTION

The gas generating propellant compositions of the invention with flame temperatures below 1400° K. (isobaric) are comprised of duroplastic and/or thermoplastic resin binder systems, optionally at least one additive selected from the group consisting of wetting agents, stabilizers, plasticizers and burning moderators and as the major gas generating constituent, triaminoguanidine nitrate. The composition is free of nitramine oxidizers, free of nitrocellulose as binder, free of resorcinol as stabilizer and free of liquid energetic plasticizers such as organic nitrates or nitro compounds.

Triaminogunidine nitrate as the chief gas generating constituent overcomes the prior art problems since this compound is not hygroscopic, has high contents of nitrogen and hydrogen, yields on combustion products of low molecular weight, is indefinitely storable and easy to process. In the preferred embodiment, the content of triaminoguanidine nitrate amounts from 60% up to 80% by weight of the total composition.

Examples of suitable binding agents are duroplastic binder systems based on polyurethanes, polyesters and polybutadienes and/or thermoplastic binder systems based on ethyl cellulose, cellulose acetate or polybutylene and they usually comprises 5 to 20% by weight of the compositions. The compositions may also contain conventional additives such as wetting agents, stabilizers, plasticizers and/or burning moderators.

The gas generating propellants of the invention are characterized by simple manufacturing (mixing of the components and subsequent casting and/or pressing), favorable compatibility of the chief gas generating constituent with the binder system, good chemical stability and, even with high amounts of triaminoguanidine nitrate, unexpected excellent mechanical properties whereby its use in a case-bonded design is possible as well.

The propellants of the present invention are further characterized by the required slow, but in a range of about 25% adjustable, burning rate and are of good handling and storage life. The propellant grains manufactured from this propellant composition can be easily and durably insulated and exhibit good ignition properties, even at temperatures of minus degrees.

As the compositions of the propellants contain only the elements carbon, nitrogen, oxygen and hydrogen, the combustion does not form any corrosive gases or particles. There is a high mole yield and therefore the flame temperature and correspondingly the temperature at nozzle exit are low. The said properties result in the desired low load of the subsequently added aggregates.

In the following examples, there are described several preferred embodiments to illustrate the invention. However, it is to be understood that the invention is not intended to be limited to the specific embodiments.

| | 1 | | 2 |
|---|---|---|---|
| | in weight % | | |
| Triaminoguanidine nitrate | 75,00 | | 75,00 |
| Polyol | 7,97 | | 12,64 |
| Isocyanate curing agent | 0,78 | | 1,75 |
| Plasticizer | 15,00 | | 10,00 |
| Processing agents and additives | 0,75 | | 0,61 |
| Burning moderators | 0,50 | | |
| | 100,00 | | 100,00 |
| Burning rate mm/s at 70 bar and NT (Normal temperature = 20° C.) | 3,7 | | 3,1 |
| Chemical stability tests | | | |
| Holland test % (Dutch test) 105° C. | | 0,04 | |
| Deflagration point °C. | | 238 | |
| Sensitivity tests | | | |
| Friction sensitivity kg | | 21,6 | |
| Impact sensitivity Nm | | 13 | |
| Mechanical properties | −30° C. | +20° C. | +50° C. |
| Tensile strength bar | 10,5 | 5,4 | 4,3 |
| Elongation % | 72,4 | 38,0 | 39,5 |
| Elastic modulus bar | 266 | 55 | 44 |
| Flame temperature K | | 1 284° | |
| Temperature at nozzle exit K | | 447° | |
| Gas yield mol/kg | | 55,5 | |
| Gas composition Mol % | | | |
| $CO_2$ | | 3,0 | |
| $H_2O$ | | 8,7 | |
| $N_2$ | | 28,5 | |
| CO | | 20,4 | |

-continued

| | 1 | 2 |
|---|---|---|
| | in weight % | |
| $H_2$ | 34,8 | |
| $CH_4$ | 4,4 | |
| $NH_3$ | 0,1 | |

Various modifications of the compositions of the invention may be made without departing from the spirit or scope thereof and it is understood that the invention is intended to be limited only as defined in the appended claims.

What we claim is:

1. A gas generating propellent composition with flame temperature below 1400° K. (isobaric) when are castable and/or pressable consisting essentially of at least one resin binder which is at least one member of the group consisting of polyurethane, polyesters, polybutadienes, ethyl cellulose, cellulose acetate and polybutylenes, optionally at least one additive selected from the group consisting of wetting agents, stabilizers, plasticizers and buring moderators and as the major gas generating constituent, 60 to 80% by weight of triaminoguanidine nitrate based total composition weight said composition being free of nitramine oxidizers, mitrocellulose binder, energetic plasticizers and recorcinol.

2. A composition of claim 1 wherein the binder is 5 tp 20% by weight of the total composition.

* * * * *

UNITED STATES PATENT AND TRADEMARK OFFICE

CERTIFICATE OF CORRECTION

PATENT NO. : 5,024,708

DATED : June 18, 1991

INVENTOR(S) : Eduard Gast and Peter Semmler

It is certified that error appears in the above-identified patent and that said Letters Patent is hereby corrected as shown below:

| Col. | Line | |
|---|---|---|
| 3 | 15 | "when" should be --which-- |
| 4 | 13 | "tp" should be --to-- |

Signed and Sealed this

Fourth Day of May, 1993

*Attest:*

*Attesting Officer*

Michael K. Kirk

MICHAEL K. KIRK

*Acting Commissioner of Patents and Trademarks*